US009711306B2

(12) United States Patent
Ozkaya et al.

(10) Patent No.: US 9,711,306 B2
(45) **Date of Patent: *Jul. 18, 2017**

(54) SWITCH APPARATUS FOR CONNECTION WITH A DC CIRCUIT

(71) Applicant: EATON CORPORATION, Cleveland, OH (US)

(72) Inventors: Metehan Ozkaya, Hixson, TN (US); Richard Donald Prohaska, Cleveland, TN (US); Warren Sipe, Cleveland, TN (US)

(73) Assignee: EATON CORPORATION, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/845,884

(22) Filed: Sep. 4, 2015

(65) Prior Publication Data

US 2016/0056000 A1 Feb. 25, 2016

Related U.S. Application Data

(63) Continuation of application No. 13/903,020, filed on May 28, 2013, now Pat. No. 9,129,765.

(51) Int. Cl.

| | |
|---|---|
| ***H01H 33/18*** | (2006.01) |
| ***H01H 1/20*** | (2006.01) |
| ***H01H 1/36*** | (2006.01) |
| ***H01H 9/44*** | (2006.01) |
| ***H01H 9/40*** | (2006.01) |

(52) U.S. Cl.

CPC ..... *H01H 33/182* (2013.01); *H01H 1/2041* (2013.01); *H01H 9/443* (2013.01); *H01H 1/365* (2013.01); *H01H 9/40* (2013.01)

(58) Field of Classification Search

CPC .... H01H 33/182; H01H 33/596; H01H 33/62; H01H 1/2041; H01H 1/42; H01H 9/443; H01F 7/02

USPC ..... 218/23, 25, 27, 30, 31, 32, 113

See application file for complete search history.

(56) References Cited

U.S. PATENT DOCUMENTS 4,614,851 A * 9/1986 Theisen ..... H01H 9/0072 218/9
4,778,961 A * 10/1988 M'Sadoques ..... H01H 1/2041 200/17 R
5,351,024 A * 9/1994 Juds ..... H01H 71/68 335/16

(Continued)

*Primary Examiner* — Truc Nguyen
*Assistant Examiner* — William Bolton
(74) *Attorney, Agent, or Firm* — Eckert Seamans; Brij Agarwal; Philip Levy

(57) ABSTRACT

A switch apparatus usable in a DC circuit employs a rotatable shaft having conductors that are removably connected with two or more pairs of contacts that are situated on line conductors and load conductors and that are connected in parallel by the conductors on the shaft. In rotating the shaft to open the switch, one pair of the contacts is electrically disconnected prior to electrical disconnection of the other pair of contacts. Further rotation of the shaft causes the other pair of contact to eventually become disconnected. Electrical arcs thus form only at the air gaps between the other pair of contacts and the conductor. Magnetic field elements in the form of permanent magnets are situated in the vicinity of the air gaps of only the other pair of contacts and apply Lorentz forces to the arcs to extinguish them.

15 Claims, 5 Drawing Sheets

(56) References Cited

U.S. PATENT DOCUMENTS

| | | | | |
|---|---|---|---|---|
| 5,990,439 | A * | 11/1999 | Pever | H01H 33/022<br>218/155 |
| 8,766,130 | B2 | 7/2014 | Prohaska et al. | |
| 2013/0328458 | A1 | 12/2013 | Crane | |

* cited by examiner

SWITCH APPARATUS FOR CONNECTION WITH A DC CIRCUIT

CROSS-REFERENCE TO RELATED APPLICATION

This application is a continuation of, and claims priority under 35 U.S.C. §120 from, U.S. patent application Ser. No. 13/903,020, filed May 28, 2013, entitled "SWITCH APPARATUS FOR CONNECTION WITH A DC CIRCUIT", the contents of which are incorporated herein by reference.

BACKGROUND

Field

The disclosed and claimed concept relates generally to electrical switching equipment and, more particularly, to a switch apparatus for connection with a DC circuit.

Related Art

Numerous types of circuit interrupters are known for use in diverse applications. In certain applications, such as low power situations, the circuit interrupter can be as simple as a mechanical switch, of which many types are known.

One type of mechanical switch that is employed in somewhat higher voltage and current applications involves the use of a rotatable shaft upon which an elongated conductor is mounted. The ends of the conductor are electrically connected with a pair of contacts when the switch is in an ON condition. When the switch is moved toward its OFF condition, the shaft is rotated, which causes the elongated conductor to pivot about a pivot axis about the shaft, which causes air gaps to form between the ends of the elongated conductor and the pair of contacts as the conductor is disconnected from the contacts. While such circuit interrupters have been generally effective for their intended purposes, they have not been without limitation.

Certain applications involve DC circuits, and it has become desirable in certain applications, such as photovoltaic applications and other application, to increase the voltage and current that flow within a circuit. This increase consequently exacerbates the difficulty of extinguishing the arcs that form at the air gaps when switching a switch from an ON condition to an OFF condition. For example, it has become desirable in photovoltaic applications to increase the number of solar arrays arranged in parallel and in series, which increases current and voltage, respectively, and which must be interrupted by a circuit interrupter such as a switch. Moreover, depending upon the orientation of the contacts in relation to one another and in relation to the movable elongated conductor, it is possible that the arc created at the air gap can tend to move along the elongated conductor toward the pivot axis of the shaft. Movement of the arc toward the pivot axis of the shaft on which the elongated conductor is mounted may tend to shorten the arc and reinforce it, which is undesirable since any arc is preferably extinguished as soon as possible. While efforts have been made to employ magnets and resultant Lorentz forces to extinguish arcs in such circuit interrupters, the result has sometimes been a circuit interrupter that can only interrupt DC power of a given polarity. Moreover, magnets (such as rare earth magnets) are rather costly, and the extensive use of such magnets can undesirably increase the cost of the resultant switching device. It thus would be desirable to provide an improved circuit interrupter that provides improved performance.

SUMMARY OF THE INVENTION

An improved switch apparatus having a high interruption capability and being usable in a DC circuit employs a rotatable shaft having conductors situated thereon that are removably connected with two or more pairs of contacts that are situated on line conductors and load conductors and that are connectable in parallel by the conductors on the shaft. In rotating the shaft to open the switch, one pair of the contacts is electrically disconnected prior to the electrical disconnection of the other pair of contacts. Further rotation of the shaft causes the other pair of contact to eventually become disconnected. Electrical arcs thus form only at the air gaps between the other pair of contacts and the conductor. Magnetic field elements in the form of permanent magnets are situated in the vicinity of the air gaps of only the other pair of contacts and apply Lorentz forces to the arcs to extinguish them.

The pair of magnetic field elements generate magnetic fields that are parallel with an axis of rotation of the shaft and that have their north poles pointed in the same direction and are thus optimized to extinguish an arc at one air gap in a first DC polarity and to extinguish an arc at the other air gap when a second (opposite) DC polarity is applied to the switch apparatus. By electrically disconnecting one pair of contacts prior to electrically disconnecting the other pair of contacts that had been in parallel therewith, electrical arcs are formed only at the other pair of contacts, and the other pair of contacts serve as sacrificial contacts. Moreover, the other pair of contacts are the only contacts where magnets are placed to extinguish arcs, thus resulting in a relatively low magnet cost while providing a high interruption capability.

Accordingly, an aspect of the disclosed and claimed concept is to provide an improved switch apparatus that is connectable with a DC circuit, that has a high interruption capability for DC of either polarity, and that has an acceptably low cost.

Another aspect of the disclosed and claimed concept is to provide an improved switch apparatus having multiple pairs of contacts that are connected in parallel, with a one pair of the contacts being electrically disconnected prior to another pair of contacts being electrically disconnected in order to cause the other pair of contacts to serve as sacrificial contacts.

Accordingly, an aspect of the disclosed and claimed concept is to provide an improved switch apparatus that is structured to be connected with a DC circuit. The switch apparatus can be generally stated as including a conduction element comprising a conductor portion and another conductor portion separated from one another, a first pair of contacts, one of which being electrically connected with the conductor portion, and the other of which being electrically connected with the another conductor portion, a second pair of contacts, one of which being electrically connected with the conductor portion, and the other of which being electrically connected with the another conductor portion, a shaft, an elongated first conductor apparatus mounted to the shaft and connectable at its ends with the first pair of contacts, an elongated second conductor apparatus mounted to the shaft and connectable at its ends with the second pair of contacts, and an arc extinction apparatus. The shaft is pivotable about a pivot axis among at least a first position, a second position, and a third position. In the first position, the ends of the first conductor apparatus are electrically connected with the first pair of contacts, and the ends of the second conductor apparatus are electrically connected with the second pair of contacts. In the second position, the ends of the first conductor apparatus are electrically connected with the first pair of contacts, and the ends of the second conductor apparatus are electrically disconnected from the second pair of contacts. In the third position, a pair of air gaps exists between the first conductor apparatus and the first pair of contacts, and the ends of the second conductor apparatus are electrically disconnected from the second pair of contacts. The arc extinction apparatus can be generally stated as including a pair of magnetic field elements, one magnetic field element of the pair of magnetic field elements being situated adjacent one first contact of the first pair of contacts and being structured to generate a magnetic field oriented parallel with the pivot axis, the other magnetic field element of the pair of magnetic field elements being situated adjacent the other first contact of the first pair of contacts and being structured to generate another magnetic field oriented parallel with the pivot axis, the magnetic field and the another magnetic field having their north poles pointed in the same direction.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
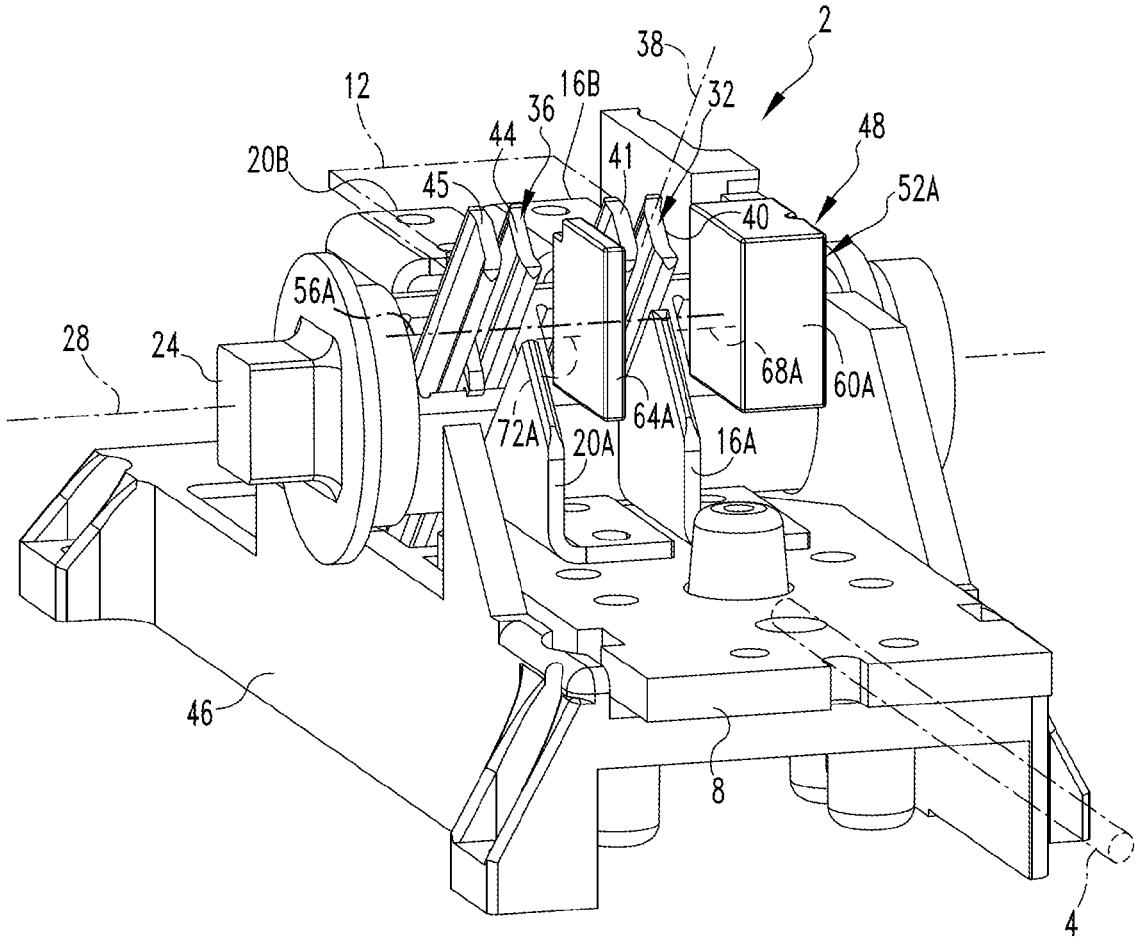
FIG. 1 is a perspective view of an improved switch apparatus in accordance with the disclosed and claimed concept.
Figure 2:
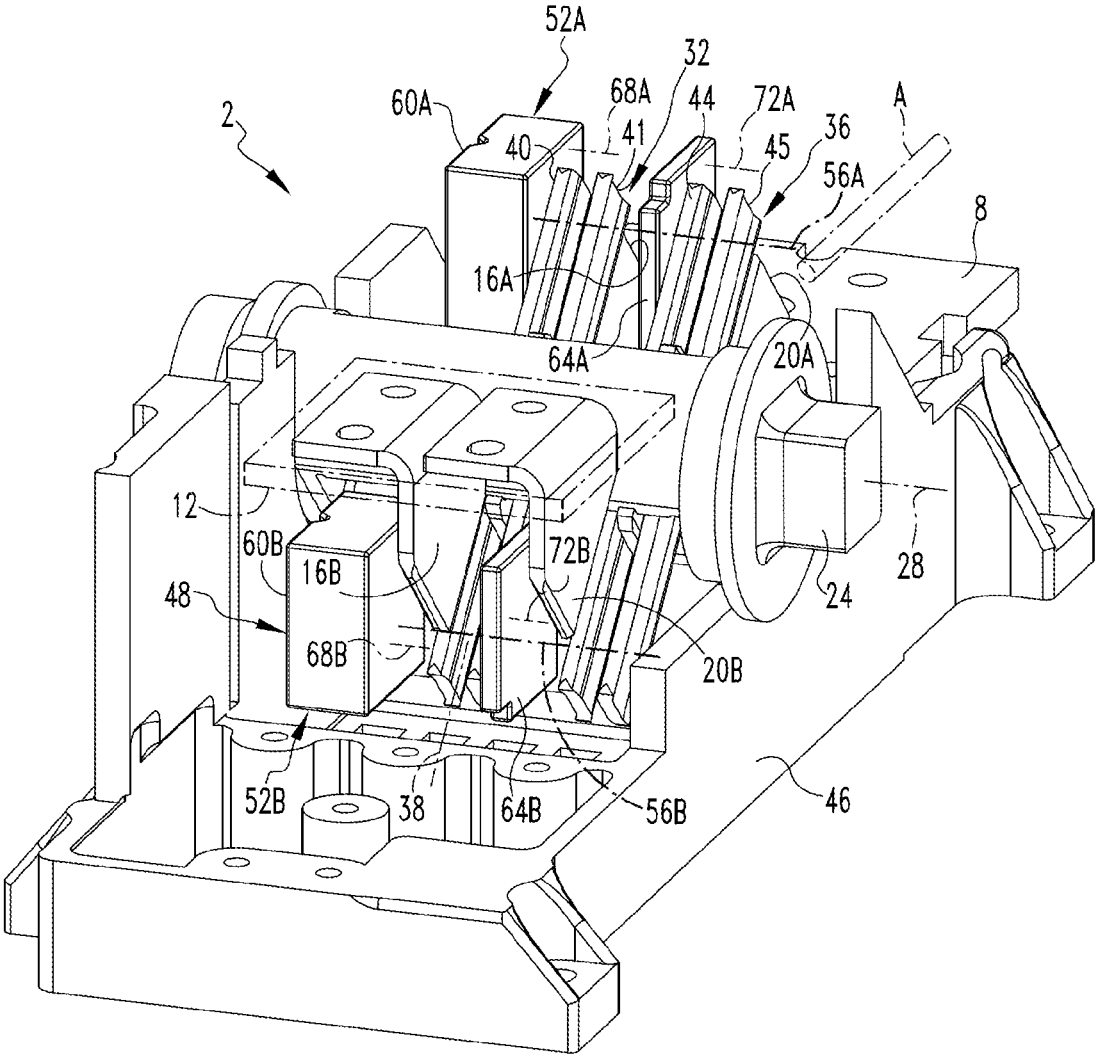
FIG. 2 is another perspective view of the switch apparatus of FIG. 1.

An improved switch apparatus 2 in accordance with the disclosed and claimed concept is depicted generally in FIGS. 1 and 2 in an OPEN position. The switch apparatus 2 is connectable with a DC circuit 4 which is schematically depicted in FIG. 1 and which can be of either polarity while still being interruptible by the switch apparatus 2.

As can be understood from FIGS. 1 and 2, the switch apparatus 2 includes a line conductor 8 and further includes a load conductor 12 that is depicted in broken lines in FIGS. 1 and 2 for clarity of illustration. The line and load conductors 8 and 12 are, by themselves, electrically separated but are electrically connectable together to close the DC circuit 4, as will be set forth in greater detail below. As such, the line and load conductors 8 and 12 can be said to together form a conduction element of the switch apparatus 2. It is understood that the expressions "line" and "load" in the context of the line and load conductors 8 and 12 or elsewhere are intended merely for purposes of illustration and description and are not intended to be limiting. As such, the line conductor 8 can be connected with either a line or a load, and the load conductor 12 can likewise be connected with either a line or a load without departing from the present concept.

The switch apparatus 2 further includes a pair of first contacts 16A and 16B (collectively herein referred to with the numeral 16) and a pair of second contacts 20A and 20B (collectively referred to herein with the numeral 20) that are situated on the line and load conductors 8 and 12. More particularly, the first contact 16A and the second contact 20A are both situated on and electrically connected with the line conductor 8, and the first contact 16B and the second contact 20B are situated on and electrically connected with the load conductor 12. As will be set forth in greater detail below, the first contacts 16 are electrically connectable together, and the second contacts 20 are electrically connectable together in parallel with the first contacts 16. It is also noted that more than two pairs of contacts can be provided, as necessary, to increase the interruption capability of the switch apparatus 2.

The switch apparatus 2 further includes a shaft 24 that is pivotable about a pivot axis 28, and also includes a first conductor apparatus 32 and a second conductor apparatus 36 that are situated on the shaft 24. The first and second conductor apparatuses 32 and 36 are each elongated and extend radially from the shaft 24. The first and second conductor apparatuses 32 and 36 are electrically in parallel with one another when connected together with the pairs of first and second contacts 16 and 20. Moreover, the first and second conductor apparatuses 32 and 36 can be said to be physically oriented parallel with one another and to extend generally in a common plane 38 that extends through the pivot axis 28.

The first conductor apparatus 32 in the depicted exemplary embodiment comprises two conductors, i.e., a pair of first conductors 40 and 41. The second conductor apparatus 36 in the depicted exemplary embodiment likewise comprises two conductors, i.e., a pair of second conductors 44 and 45. Depending upon the rotational position of the shaft 24 about the pivot axis 28, the first conductors 40 and 41 may be electrically connected at opposite ends thereof with the first contact 16. Further depending upon the rotational position of the shaft 24 about the pivot axis 28, the second conductors 44 and 45 may be electrically connected at opposite ends thereof with the second contact 20. As will be set forth in greater detail below, the first and second contacts 16 and 20 and the first and second conductors 40, 41, 44 and 45 are together arranged such that the second contacts 20 are electrically connectable together only if the first contacts 16 are electrically connected together. However, the first contacts 16 are electrically connectable together even if the second contacts 20 are electrically disconnected.

The switch apparatus 2 can further be said to include a support 46 upon which the line and load conductors 8 and 12, the pairs of first and second contacts 16 and 20, the shaft 24, and the first and second conductor apparatuses 32 and 36 are disposed. Although not expressly depicted herein, it is understood that the switch apparatus 2 is intended to further be disposed within an enclosure or to have an enclosure mounted on the support 46 in order to electrically isolate the aforementioned components that are situated on the support 46 from exposure to the environment.

The switch apparatus 2 further and advantageously includes an arc extinction apparatus 48 that is situated on the support 46 and that is positioned generally in the vicinity of the first contacts 16. The arc extinction apparatus 48 can be said to include two magnetic field elements 52A and 52B (collectively referred to herein with the numeral 52) which each generate a magnetic field 56A and 56B, respectively, (collectively referred to herein with the numeral 56) that are parallel to one another and parallel with the pivot axis 28. As will be set forth in greater detail below, the north poles of the magnetic field elements 56 point in the same direction.

In the depicted exemplary embodiment, the magnetic field element 52A includes an outboard magnet 60A and an inboard magnet 64A that are situated at alternate sides of the first contact 16A and which have north poles 68A and 72A, respectively, that are oriented in the same direction. Likewise, the magnetic field element 52B includes an outboard magnet 60B and an inboard magnet 64B that are situated at alternate sides of the first contact 16B and which have north poles 68B and 72B, respectively, that are oriented in the same direction, which is the same direction as that in which the north poles 68A and 72A are oriented.

Figure 3A:
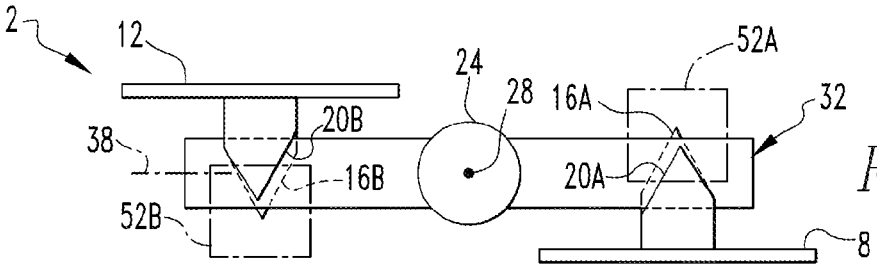
FIG. 3A is a schematic depiction of the switch apparatus in a first position, which is a CLOSED position of the switch apparatus.
Figure 3B:
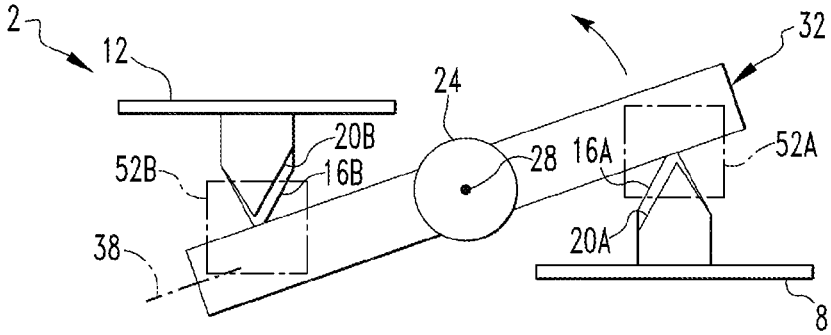
FIG. 3B is a schematic depiction of the switch apparatus in a second position.
Figure 3C:
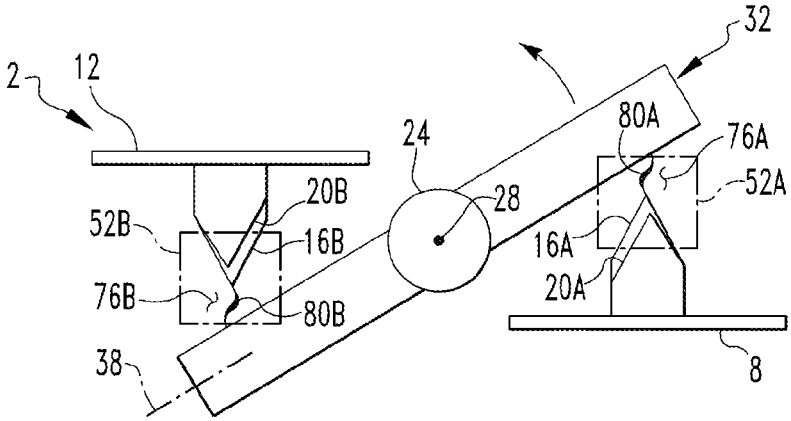
FIG. 3C is a schematic depiction of the switch apparatus in a third position.
Figure 3D:
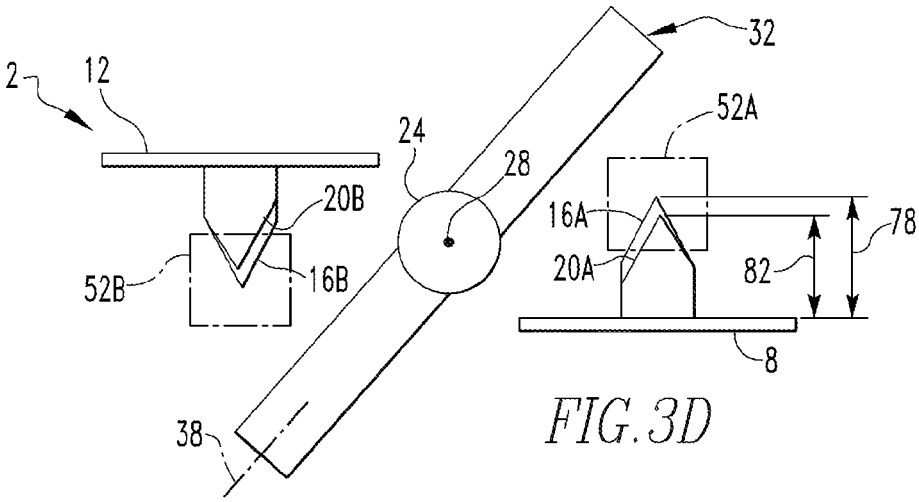
FIG. 3D is a schematic depiction of the switch apparatus in a fourth position, which is an OPEN position of the switch apparatus.

The switch apparatus 2 is schematically depicted in FIGS. 3A-3D as being movable between a first position that is depicted generally in FIG. 3A, a second position that is depicted generally in FIG. 3B, a third position that is depicted generally in FIG. 3C, and a fourth position that is depicted generally in FIG. 3D. Upon rotation of the shaft 24 in the counter-clockwise direction from the perspective of FIGS. 3A-3D, the switch apparatus 2 is sequentially movable from the first position (FIG. 3A) to the second position (FIG. 3B) to the third position (FIG. 3C) and to the fourth position (FIG. 3D). It is likewise understood that if the shaft 24 is pivoted in the clockwise direction from the perspective of FIGS. 3A-3D, the switch apparatus 2 is sequentially movable from the fourth position (FIG. 3D), to the third position (FIG. 3C), to the second position (FIG. 3B), and to the first position (FIG. 3A).

FIG. 3D is intended to depict the shaft 24 and the first and second conductor apparatuses 32 and 36 as being in the same position as is depicted generally in FIGS. 1 and 2, i.e., the fourth position of the switch apparatus 2, which is an OPEN position. In such position, the line and load conductors 8 and 12 are electrically disconnected from one another since the first conductor apparatus 32 is disconnected from the first contacts 16 and the second conductor apparatus 36 is disconnected from the second contacts 20. As will be understood from the following description, the first, second, and third positions of the switch apparatus 2 correspond with a CLOSED position of the switch apparatus 2.

When the shaft 24 is in the first position of FIG. 3A, the first contacts 16 are electrically connected together via the first conductor apparatus 32, and the second contacts 20 are electrically connected together via the second conductor apparatus 36, with the second contacts 20 being electrically connected in parallel with the first contacts 16. By providing both the first contacts 16 and the second contacts 20 electrically in parallel, the switch apparatus 2 can possess a relatively higher current carrying capability than would be generally possible with only the first contacts 16 or the second contacts 20.

When the shaft 24 is rotated in the counter-clockwise direction from the first position of FIG. 3A toward the second position of FIG. 3B, the second pair of contacts 20 become electrically disconnected (FIG. 3B) while the first pair of contacts 16 remain electrically and physically connected together. That is, upon rotation of the shaft 24 from the first position of the switch apparatus 2, as is depicted generally in FIG. 3A, to the second position of the switch apparatus 2, as is depicted generally in FIG. 3B, the second contacts 20 become electrically disconnected. However, the first contacts 16 remain electrically and physically connected together in the second position since the first conductor apparatus 32 remains electrically connected with the first contacts 16. This is because the first contacts 16 are relatively taller in the vertical direction from the perspective of FIGS. 3A-3D than the second contacts 20. That is, and as can be seen in FIG. 3D, the first contacts 16 can be said to be of a relatively taller dimension 78 in a direction extending away from the conduction element, and the second contacts 20 can be said to be of a relatively shorter dimension 82 in the direction extending away from the conduction element.

Upon further rotation of the shaft 24 in the counter-clockwise direction from the second position of FIG. 3B to the third position of FIG. 3C, the pair of first conductors 40 and 41 become physically disconnected from the pair of first contacts (FIG. 3C). However, FIG. 3C also depicts the pair of first conductors 40 and 41 being in sufficiently close physical proximity to the first contacts 16 that a pair of arcs 80A and 80B (collectively referred to herein with the numeral 80) are formed at a pair of air gaps 76A and 76B, respectively, (collectively referred to herein with the numeral 76) which are disposed between the first contacts 16 and the first conductors 40 and 41, in which situation a certain level of DC current flows through the switch apparatus 2. As will be set forth in greater detail below, however, the arcs 80 are desirably extinguished by the arc extinction apparatus 48. Nevertheless, the mere possibility of current flow through the switch 2 in the third position of the switch apparatus 2 (FIG. 3C) causes the third position of the switch apparatus 2 to be considered a CLOSED position.

Since the first and second conductor apparatuses 32 and 36 are oriented parallel with one another in a common plane along the common axis 38, a rotation of the shaft 24 in the counter-clockwise direction with respect to FIGS. 3A-3D will result in the second contacts 20 being electrically disconnected from the second conductor apparatus 36 (FIG. 3B) prior to the first contacts 16 being physically disconnected from the first conductor apparatus 32 (FIG. 3C). Since in the second position of FIG. 3B the first contacts 16 remain electrically connected together, and since the second contacts 20 had been electrically connected together in parallel with the first contacts 16, electrical arcs generally do not form at air gaps between the second contacts 20 and the second conductor apparatus 36.

It is understood that other configurations of contacts and conductors can be employed without departing from the present concept. For example, if the first and second conductor apparatuses did not both lie in a common plane, the pairs of contacts that might be employed may be of the same height but at different positions to cause one pair of contacts to be connected at a different rotational position of the shaft than the connection of another pair of contacts. Other variations will be apparent to one of ordinary skill in the art within the scope of the disclosed and claimed concept.

As can be understood from the foregoing, therefore, upon rotation of the shaft 24 from the first position of FIG. 3A and the second position of FIG. 3B, no arcs are formed between the second contacts 20 and the second conductor apparatus 36 when they become physically and electrically disconnected. This is because the first contacts 16 remain electrically connected together at the point when the second contacts 20 become electrically disconnected. However, when moving from the second position of FIG. 3B to the third position of FIG. 3C, at which point the first conductor apparatus 32 becomes physically disconnected from the first contacts 16, the arcs 80 are formed at the air gaps 76.

The arc extinction apparatus 48 is thus advantageously provided to rapidly extinguish the arcs 80 at the air gaps 76 when the switch apparatus 2 is moved from its second position to its third position. The arc extinction apparatus 48 rapidly extinguishes the arcs 80 via the application of Lorentz forces to the arcs 80.

Figure 4:
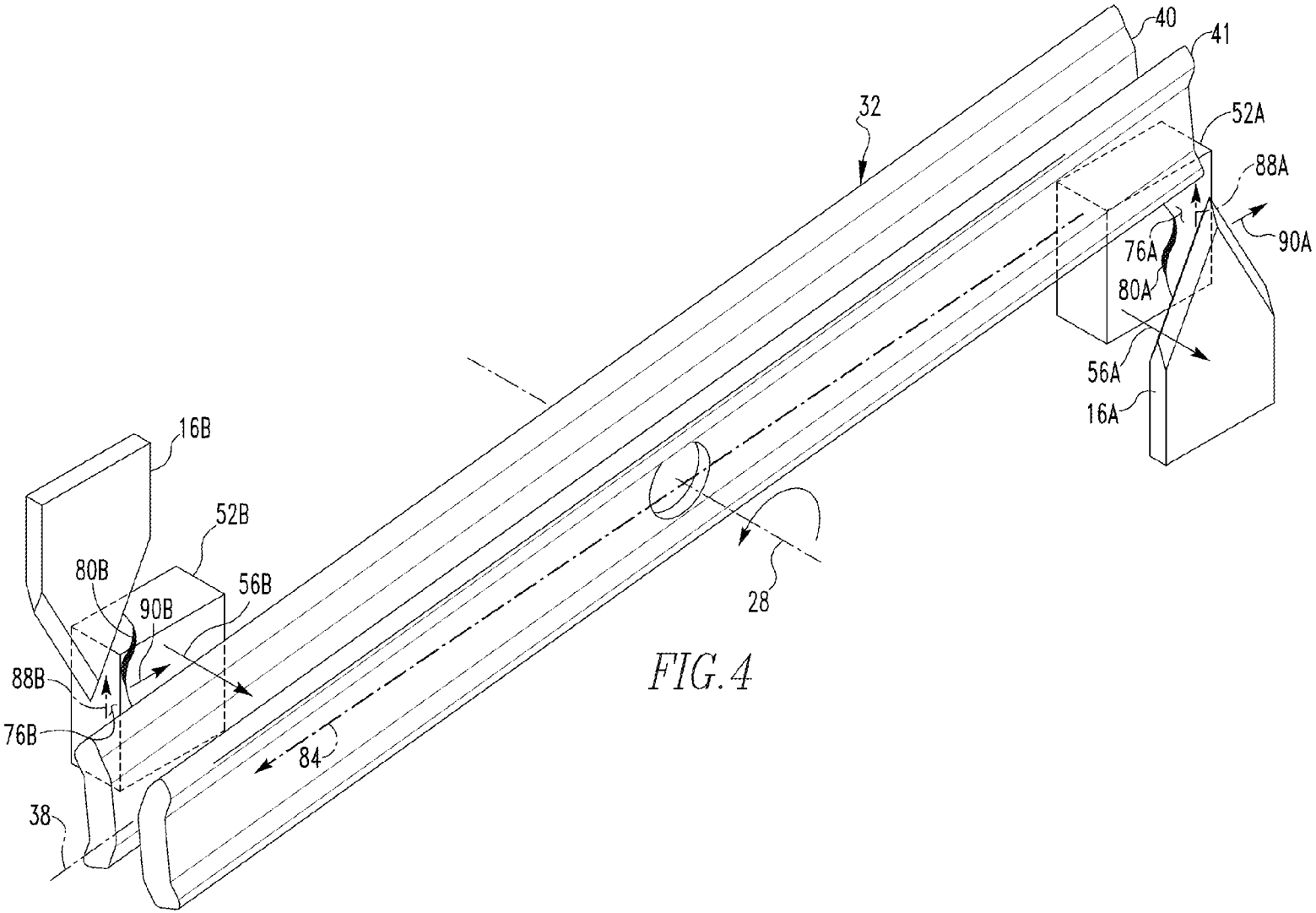
FIG. 4 is a further schematic depiction of the switch apparatus in the third position of FIG. 3C and depicting Lorentz forces acting on electrical arcs when DC of a first polarity is connected with the switch apparatus.

The first conductor apparatus 32 is depicted in FIG. 4 as being in the third position with respect to the first contacts 16 and as having DC of a first polarity being connected between the line and load conductors 8 and 12. In this regard, the direction of the current flow through the first conductor apparatus 32 is indicated generally with the numeral 84, and the direction of the current flow at the air gaps 76 as a result of the arcs 80 is depicted at the numerals 88A and 88B (collectively referred to herein with the numeral 88) at the air gaps 76A and 76B, respectively.

When the DC of the first polarity is applied, as is depicted generally in FIG. 4, the action of the magnetic fields 56A and 56B on the arcs 80A and 80B results in the application of Lorentz forces 90A and 90B (collectively referred to herein with the numeral 90) on the arcs 80A and 80B, respectively, according to the well understood Right Hand Rule. As can be understood from FIG. 4, the Lorentz force 90A causes the arc 80A to be pushed in a direction generally away from the pivot axis 28, whereas the Lorentz force 90B causes the arc 80B to be pushed in a direction generally toward the pivot axis 28. While it is understood that the pushing of the arc 80B toward the pivot axis 28 would typically cause the arc 80B to become shortened and thereby reinforced and strengthened, it can be understood that the extinction of either the arc 80A or the arc 80B will result in the extinction of both arcs 80. As such, the Lorentz force 90A applied to the arc 80A, which is in a direction generally away from the pivot axis 28, causes both arcs 80 to be extinguished very rapidly.

Figure 5:
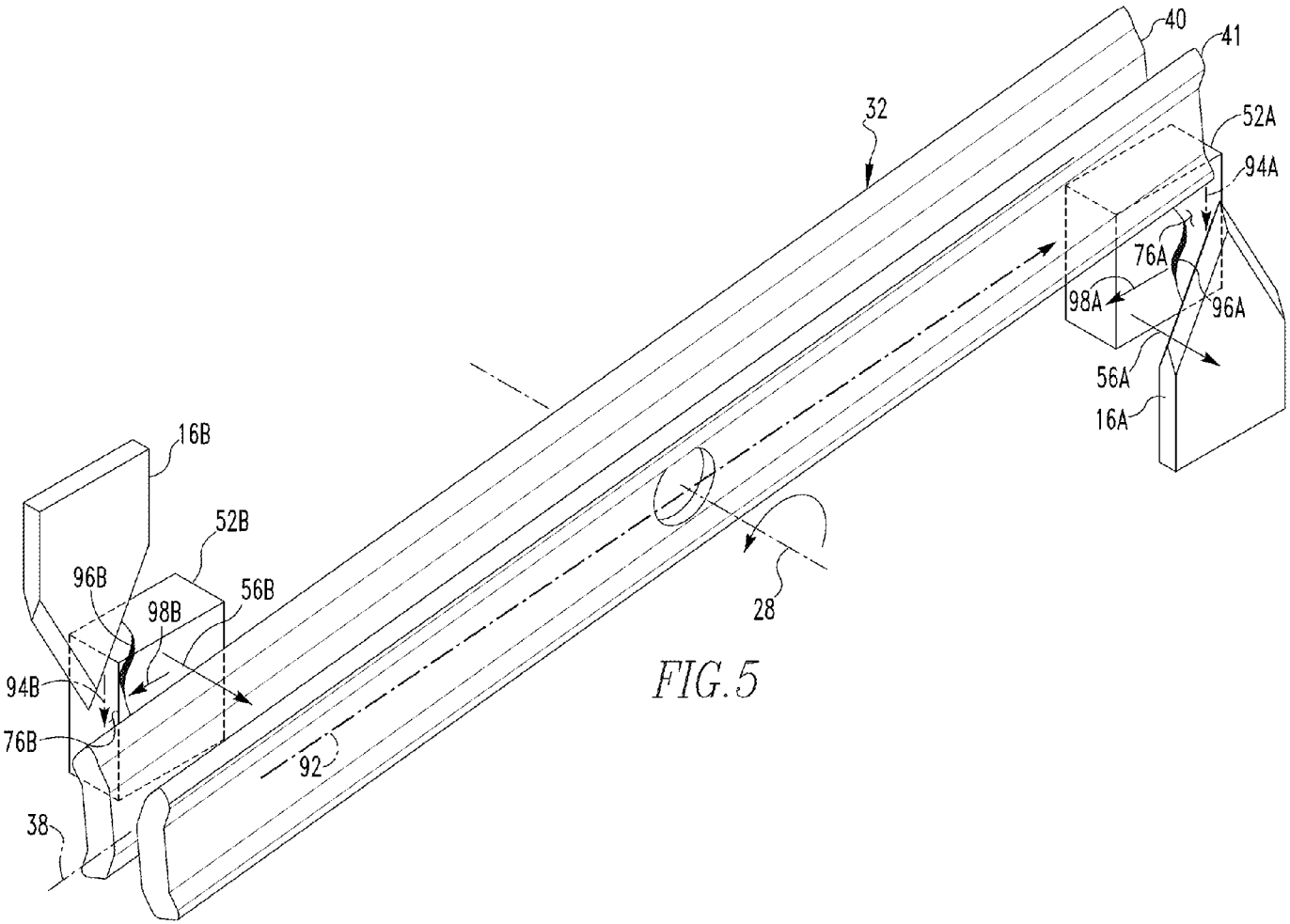
FIG. 5 is a further schematic depiction of the switch apparatus in the third position of FIG. 3C and depicting Lorentz forces acting on electrical arcs when DC of a second polarity is connected with the switch apparatus.

FIG. 5 depicts an instance wherein DC of an opposite polarity (i.e., opposite that of FIG. 4) is applied to the switch apparatus 2 in the third position. The direction of the current flow in the first conductor apparatus 32 is indicated generally at the numeral 92, and the direction of the current flow at the air gaps 76A and 76B is represented generally at the numerals 94A and 94B (collectively referred to herein at the numeral 94) and which take the form of electrical arcs 96A and 96B (collectively referred to herein at the numeral 96). The magnetic fields 56 cause Lorentz forces 98A and 98B (collectively referred to herein at the numeral 98) to act on the arcs 96 in directions generally opposite those of the Lorentz forces 90A and 90B, respectively.

That is, whereas the Lorentz force 90A caused the arc 80A to move in a direction generally away from the pivot axis 28, the Lorentz force 98A causes the arc 96A to move in a direction generally toward the pivot axis 28. Likewise, the Lorentz force 98B acting on the arc 96B causes the arc 96B to move in a direction generally away from the pivot axis 28, which is an opposite direction from that of FIG. 4. The arc 96B is expected to be extinguished prior to the extinction of the arc 96A since the arc 96B is being pushed by the Lorentz force 98B in a direction generally away from the pivot axis 28 and, as before, the extinction of either arc 96 will result in the extinction of both arcs 96.

It thus can be seen that the magnetic field elements 52 applied to the first contacts 16 results in rapid extinction of the arcs 80 and 96 regardless of the polarity of the DC applied to the switch apparatus 2. By causing the first contacts 16 to remain electrically connected together via the first conductor apparatus 32 subsequent to the second contacts 20 becoming electrically disconnected from the second conductor apparatus 36, the arcs 80 and 96 advantageously occur only at the first contacts 16 and not at the second contacts 20, with the advantageous result that the arc extinction apparatus 48 need provide only the magnetic field elements 52 in the vicinity of the first contacts 16. This reduces costs by avoiding the need for such additional magnetic field elements to be placed in the vicinity of the second contacts 20. The switch apparatus 2 thus advantageously is configured to interrupt high current levels of DC of either polarity at an acceptably low cost.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A switch apparatus that is structured to be connected with a DC circuit, the switch apparatus comprising:

a conductor comprising a conductor portion and another conductor portion separated from one another;

a pair of first contacts;

a pair of second contacts;

one first contact of the pair of first contacts and one second contact of the pair of second contacts each being electrically connected with the conductor portion;

the other first contact of the pair of first contacts and the other second contact of the pair of second contacts each being electrically connected with the another conductor portion;

an arc extinction apparatus comprising a pair of magnetic field elements, one magnetic field element of the pair of magnetic field elements being situated adjacent the one first contact and being structured to generate a magnetic field, the other magnetic field element of the pair of magnetic field elements being situated adjacent the other first contact and being structured to generate another magnetic field;

a movable apparatus comprising an elongated first conductor apparatus that is electrically connectable with the pair of first contacts and an elongated second conductor apparatus that is electrically connectable with the pair of second contacts; and the movable apparatus being movable among:

a first position wherein the first conductor apparatus is electrically connected with the pair of first contacts, and the second conductor apparatus is electrically connected with the pair of second contacts, a second position wherein the first conductor apparatus is electrically connected with the pair of first contacts, and the second conductor apparatus is electrically disconnected from the pair of second contacts, and a third position wherein a pair of air gaps exists between the first conductor apparatus and the pair of first contacts, and the second conductor apparatus is electrically disconnected from the pair of second contacts.

2. The switch apparatus of claim 1 wherein the magnetic field and the another magnetic field have their north poles pointed in the same direction.

3. The switch apparatus of claim 2 wherein the magnetic field and the another magnetic field are oriented parallel with the pivot axis.

4. The switch apparatus of claim 1 wherein the movable apparatus further comprises a movable shaft upon which the first and second conductor apparatuses are situated.

5. The switch apparatus of claim 4 wherein the shaft is pivotable to move the movable apparatus among the first, second, and third positions.

6. The switch apparatus of claim 5 wherein the shaft is pivotable about a pivot axis between the first and third positions, and wherein the second position is rotationally disposed between the first and third positions.

7. The switch apparatus of claim 6 wherein in the third position:

one of the magnetic field and the another magnetic field is structured to subject at least a portion of an electrical arc at an air gap of the pair of air gaps to Lorentz forces in a first direction away from the pivot axis when DC of a first polarity is applied to the switch apparatus; and the other of the magnetic field and the another magnetic field is structured to subject at least a portion of another electrical arc at another air gap of the pair of air gaps to Lorentz forces in a second direction away from the pivot axis when DC of a second polarity is applied to the switch apparatus.

8. The switch apparatus of claim 7 wherein the first direction away from the pivot axis and the second direction away from the pivot axis are generally opposite one another.

9. The switch apparatus of claim 6 wherein the magnetic field and the another magnetic field in the third position are structured to simultaneously subject at least a portion of each of a pair of electrical arcs at the air gaps to Lorentz forces in the same direction.

10. The switch apparatus of claim 1 wherein the pair of magnetic field elements comprise permanent magnets.

11. The switch apparatus of claim 10 wherein one magnetic field element of the pair of magnetic field elements comprises a pair of permanent magnets which are situated at alternate sides of the one first contact and whose north poles are pointed in the same direction.

12. The switch apparatus of claim 11 wherein the other magnetic field element of the pair of magnetic field elements comprises another pair of permanent magnets which are situated at alternate sides of the other first contact and whose north poles are pointed in the same direction as the north poles of the pair of permanent magnets.

13. The switch apparatus of claim 1 wherein the magnetic field and the another magnetic field in the third position are structured to simultaneously subject at least a portion of each of a pair of electrical arcs at the air gaps to Lorentz forces.

14. The switch apparatus of claim 1 wherein the first conductor apparatus and the second conductor apparatus are oriented parallel with one another.

15. The switch apparatus of claim 1 wherein in the first position the first conductor apparatus and the second conductor apparatus each electrically connect together the conductor portion and the another conductor portion.

* * * * *